US007533595B2

(12) United States Patent
Domenico

(10) Patent No.: US 7,533,595 B2
(45) Date of Patent: May 19, 2009

(54) LAMINA CUTTER

(75) Inventor: Anthony J. Domenico, Moreno Valley, CA (US)

(73) Assignee: Square One Parachutes, Inc., Perris, CA (US)

( * ) Notice: Subject to any disclaimer, the term of this patent is extended or adjusted under 35 U.S.C. 154(b) by 46 days.

(21) Appl. No.: 10/830,366

(22) Filed: Apr. 22, 2004

(65) Prior Publication Data

US 2005/0235500 A1 Oct. 27, 2005

(51) Int. Cl.
*B26B 29/00* (2006.01)

(52) U.S. Cl. ..... 83/13; 30/286; 30/294

(58) Field of Classification Search ..... 30/294, 30/286–291, 295; D8/98–99; 83/13
See application file for complete search history.

(56) References Cited

U.S. PATENT DOCUMENTS

| | | | | | |
|---|---|---|---|---|---|
| 2,810,194 | A | | 10/1957 | Unsinger | |
| 2,881,520 | A | * | 4/1959 | Mito | 30/294 |
| 3,365,798 | A | | 1/1968 | Cunningham | |
| 3,673,687 | A | | 7/1972 | Phillips et al. | |
| 3,710,444 | A | | 1/1973 | Fishman | |
| 4,064,626 | A | * | 12/1977 | Meshulam et al. | 30/294 |
| 4,134,206 | A | | 1/1979 | Beermann | |
| 4,680,861 | A | | 7/1987 | Meurer | |
| D294,797 | S | | 3/1988 | Itoh | |
| 4,887,355 | A | * | 12/1989 | Colbert | 30/295 |
| 5,046,253 | A | | 9/1991 | Ireland | |
| 5,282,316 | A | | 2/1994 | Anderson | |
| D352,440 | S | | 11/1994 | Perigny | |
| 5,419,044 | A | * | 5/1995 | Valliere | 30/2 |
| D381,886 | S | | 8/1997 | Domenico | |
| 5,737,842 | A | * | 4/1998 | Freedman | 30/294 |
| 5,768,787 | A | * | 6/1998 | Ireland | 30/294 |
| 5,829,321 | A | | 11/1998 | Domenico | |
| 6,513,249 | B2 | * | 2/2003 | Linton et al. | 30/294 |

* cited by examiner

*Primary Examiner*—Stephen Choi
(74) *Attorney, Agent, or Firm*—Nydegger & Associates

(57) ABSTRACT

A lamina cutter includes a handle with a blade having a cutting edge mounted thereon. A guard member is affixed to the blade, and is positioned at a distance from the handle to establish a channel having a width "w" therebetween. The blade then extends between the handle and the guard member to present its cutting edge across the width of the channel. In use, a lamina (e.g. a sheet) having a thickness "t" (wherein "t"<"w"), is advanced through the channel and against the cutting edge to cut the lamina.

13 Claims, 1 Drawing Sheet

LAMINA CUTTER

FIELD OF THE INVENTION

The present invention pertains generally to cutting instruments. More particularly, the present invention pertains to cutting instruments that incorporate safety features which prevent accidental injury to the user. The present invention is particularly, but not exclusively, useful as a safety cutter for cutting laminae.

BACKGROUND OF THE INVENTION

Regardless of the nature of an item that is to be cut, or the nature of the device or mechanism that is to be used to cut the item, safety is always an issue.

Anytime the cutting edge of a blade is exposed, and left unprotected, a safety issue is presented that needs to be consciously addressed. Typically, proper training in the use of knives, scissors, saws and other type cutting instruments is relied on for the prevention of accidents. Despite abundant precautions, however, and even with proper training, accidents do happen. Thus, in order to further reduce the probability that an exposed cutting edge will cause an injury accident, it is preferable for the instrument to include a safety feature that is intended to prevent such incidents.

An activity that is very commonly accomplished by using the exposed cutting edge of a blade is the cutting of a lamina. More specifically, and as intended here, a lamina can be any structure that is formed as a thin layer, plate or sheet; and that is made of a material that can be cut by a hand-operated implement. For example, laminae include, but are certainly not limited to, such items as paper, cardboard, cloth, clothing, straps, leather, canvas and plastic sheets. In each example, the laminar structure that is to be cut is thin. Further, unless it is being cut, the laminar structure is otherwise strong and generally tear-resistant.

In order to cut a lamina using a hand-held instrument, the lamina must somehow be exposed to the cutting element of the instrument. On the other hand, it is desirable that the user of the instrument be somehow protected from the cutting element while it is being used. Of course, although the user is protected, the cutting element must still be able to make contact with the object that is to be cut.

In light of the above, it is an object of the present invention to provide a safety cutter for cutting laminae that establishes dimensions for an access to the cutting element that effectively prevents the accidental insertion of an appendage (e.g. a finger) through the access and into contact with the cutting edge. Another object of the present invention is to provide a safety cutter for cutting laminae that allows a lamina to be cut without dangerously exposing the user to the cutting element. Still another object of the present invention is to provide a safety cutter for cutting laminae that is easy to use, is relatively simple to manufacture, and is comparatively cost effective.

SUMMARY OF THE INVENTION

A safety cutter for cutting a lamina includes a substantially flat, elongated stainless steel cutting blade. The cutting blade defines an axis that lies between a first side edge and a second side edge that are both substantially coplanar with the axis. Additionally, the cutting blade has an in-plane cutting edge that extends between the first side edge and the second side edge.

With the blade configuration described above, a guard member is affixed to the first side edge of the blade, and a handle is affixed to the second side edge of the blade. In this combination, the handle and the guard member are opposite the blade axis from each other, and they establish a channel between them which has a width "w" of a predetermined distance. The blade is thus held in the channel between the handle and the guard member for cutting a lamina as the lamina is advanced along the axis and through the channel.

It is an important safety feature of the present invention that the width "w" of the channel is designed to be less than the width of a finger. Typically, the width "w" will be greater than approximately 0.125 inches. Further, the cutting edge of the blade is recessed in the channel so that a finger of the user can not enter the channel and come in contact with the cutting edge.

Several different embodiments of the present invention can be envisioned. For instance, the shape of the handle can be varied as desired. For another, the cutting edge of the blade may be inclined at a variable angle $\alpha$ relative to the axis. Specifically, for one embodiment of the safety cutter, the angle $\alpha$ can be less than ninety degrees ($\alpha<90°$). In another embodiment, the angle $\alpha$ can be greater than ninety degrees ($\alpha>90°$).

As intended for the operation of the safety cutter of the present invention, the lamina to be cut can be taken from a wide variety of materials. For example, the lamina can be paper, cardboard, cloth or plastic sheets. In any event, it is important that the lamina have a thickness "t" that is less than the width "w" of the channel in the safety cutter.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
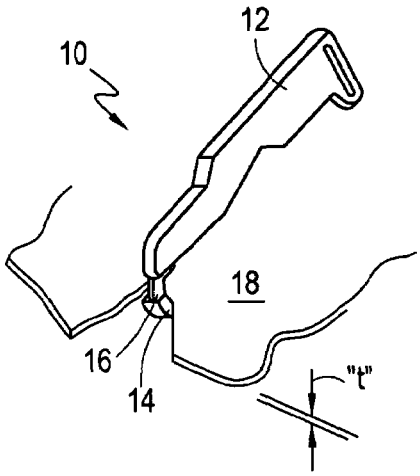
FIG. 1 is a perspective view of a safety cutter of the present invention being used to cut a lamina.

Referring initially to FIG. 1 a safety cutter in accordance with the present invention is shown, in use, and is generally designated 10. In combination, the cutter 10 includes a handle 12 and a guard member 14 that cooperate with each other to hold a cutting blade 16 between them. With this combination, as shown, the cutter 10 is useful for cutting a lamina 18. As intended for the present invention, the lamina 18 can be any thin structure that has a thickness "t". Further, the lamina 18 can be made from a variety of materials, to include: paper, cardboard, cloth, clothing, straps, leather, canvas and plastic sheets.

Figure 2:
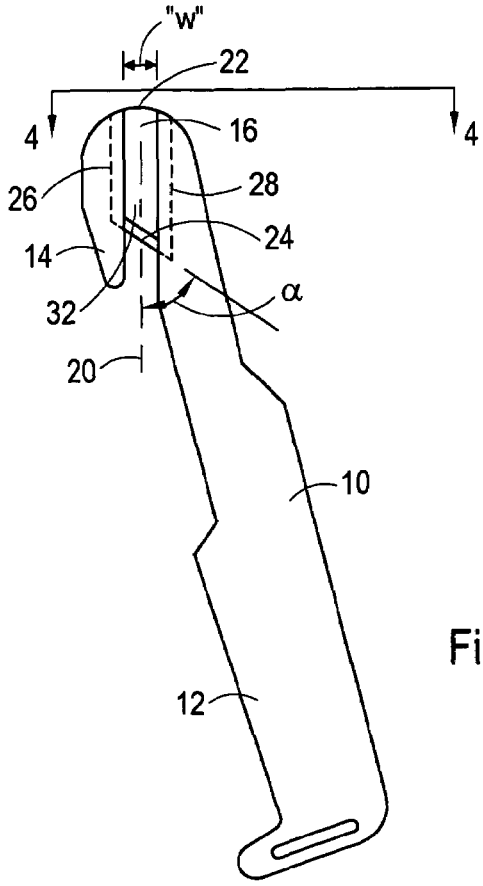
FIG. 2 is an elevation view of an embodiment of a safety cutter in accordance with the present invention, with portions of the blade shown in phantom for clarity.

The structural details of blade 16, as it is mounted on the cutter 10, will be best appreciated by referring to FIG. 2. For the present invention, the blade 16 is preferably flat and is made of a stainless steel, or of some other strong material that is capable of cutting a particular lamina 18 (e.g. a reinforced plastic). As shown in FIG. 2, the blade 16 is elongated and defines an axis 20 that extends lengthwise along the blade 16 from an end 22 to a straight cutting edge 24. Further, the blade 16 is bounded by a side edge 26 (shown in phantom) and a side edge 28 (also shown in phantom). Both of the side edges 26 and 28 of blade 16 are substantially parallel to the axis 20 and are on opposite sides of the axis 20.

In the construction of the cutter 10 of the present invention, both the handle 12 and guard member 14 are preferably made of a moldable plastic material. In particular, by cross-referencing the cutter 10 (shown in FIG. 2) with the cutter 10' (shown in FIG. 3), it will be appreciated that the actual shape of the handle 12 can be molded to present additional features as desired. For example, the handle 12' of cutter 10' is shown formed with a finger grip 30. In any event, the handle 12 and the handle 12' serve substantially the same functionality, and each is affixed to the side edge 28 of blade 16 in any manner well known in the pertinent art, such as by bonding, gluing or mechanical fixation. Similarly, the guard member 14 is affixed to the side edge 26 of blade 16. The consequence here is that a channel 32 is established between the handle 12 and the guard member 14, with the blade 16 and its cutting edge 24 positioned in the channel 32.

Figure 3:
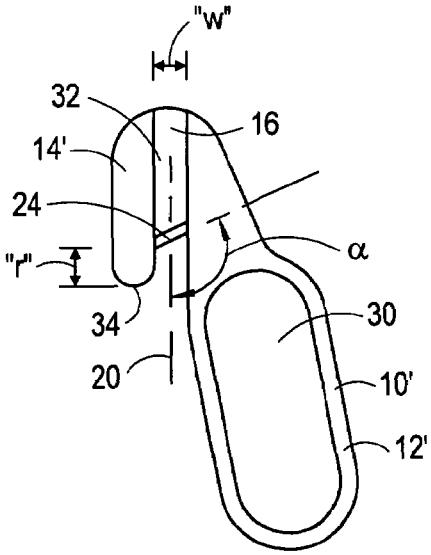
FIG. 3 is an elevation view of another embodiment of a safety cutter in accordance with the present invention.

Again, by cross-referencing the cutter 10 (shown in FIG. 2) with the cutter 10' (shown in FIG. 3), it will be appreciated that in all important respects, the cutter 10 is similar to the cutter 10'. Some design features, however, may differ. For instance, as mentioned above, the handle 12 of cutter 10 may be different in shape from the handle 12' of the cutter 10'. Another difference may be the inclination and the degree of the angle $\alpha$ of the cutting edge 24. As shown, the inclination angle $\alpha$ of cutting edge 24 in cutter 10 is different from the inclination angle $\alpha$ for the cutting edge 24 in cutter 10'. Specifically, for the cutter 10 the angle $\alpha$ is less than ninety degrees (FIG. 2), while the angle $\alpha$ for the cutter 10' is greater than ninety degrees (FIG. 3). Further, although the cutting edge 24 is shown to be straight, it will be appreciated that the cutting edge 24 may be curved, serrated of otherwise configured, as desired.

Figure 4:
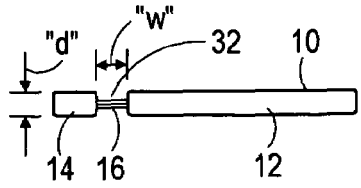
FIG. 4 is a top view of the safety cutter shown in FIG. 2, as seen along the line 4-4 in FIG. 2.

An important aspect of the present invention is that the width "w" of the channel 32 be greater than the thickness "t" of the lamina 18. Also, it is important that the cutting edge 24 of blade 16 be recessed into the channel 32 by at least the distance "r" from the nose 34 of guard member 14 (see FIG. 3). For safety reasons, the width "w" and recess distance "r" need to be sufficient to prevent the user of cutter 10 from accidentally inserting an appendage (e.g. a finger) into the channel 32 and into contact with the cutting edge 24. As an additional consideration, the sideways distance "d" (see FIG. 4) must be sufficient for this same purpose.

While the particular Lamina Cutter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A hand-held safety cutter for cutting a lamina, said cutter having a proximal edge and a distal edge defining a plane, said cutter comprising:

a guard member;

a planar blade co-planar with the plane formed by the cutter having a top surface and a bottom surface with a substantially uniform distance "u" therebetween, said blade having a first side edge and a second side edge parallel and opposite thereto, with a cutting edge and a rear edge respectively extending between the first and second edges, wherein said blade defines an axis parallel to the first and second side edges and extending through the rear edge and the cutting edge, wherein the axis is non-coincident with said guard member, wherein said guard member is fastened directly to the first side edge, and wherein the rear edge of said blade forms the distal edge of the cutter;

a substantially planar handle offset from and non-coincident with the axis, said offset handle having a first surface and a second surface parallel to the top and bottom surfaces of said blade and having a distal end fastened directly to the second side edge of said blade to hold said blade in a channel centered about the axis and having a width "w" greater than zero between a first channel edge formed by the guard member and a second channel edge formed by the offset handle, wherein the channel extends between the cutting edge and the rear edge of said blade, with said top surface and said bottom surface of said blade being exposed in the channel from the cutting edge to the rear edge, wherein the first surface and second surface of said offset handle extend away from the rear edge of the blade and past the cutting edge of the blade to a proximal end forming the proximal edge of the cutter, and wherein the cutting edge of the blade is inclined at an angle $\alpha$ relative to the axis and to the channel edges to facilitate cutting; and a grip on said proximal end of said offset handle, with the grip being directly disconnected from the guard and inclined away from the channel to expose the blade for drawing the hand-held safety cutter over the lamina to advance the lamina through the channel and against the cutting edge to cut the lamina.

2. A cutter as recited in claim 1 wherein the width "w" is greater than approximately 0.125 inches.

3. A cutter as recited in claim 1 wherein the lamina has a thickness "t" less than the width "w".

4. A cutter as recited in claim 1 wherein the guard member is circumscribed by a guard edge, wherein the handle is circumscribed by a handle edge, wherein the guard edge and handle edge are separated by a channel distance, and wherein the channel distance is always greater than or equal to the width "w".

5. A method for cutting laminae with a safety cutter which comprises the steps of:

providing a hand-held safety cutter having a proximal edge and a distal edge defining a plane and having a substantially planar blade co-planar with the plane formed by the cutter and defining an axis, said blade having a first side edge and a second side edge, wherein each side edge is substantially coplanar with the axis, and wherein said blade has a cutting edge and a rear edge, with said cutting edge and said rear edge extending between the first side edge and the second side edge and with said rear edge forming the distal edge of the cutter; a guard member fastened directly to the first side edge of the blade, wherein the axis is non-coincident with said guard member; a substantially planar handle offset from and non-coincident with the axis, said offset handle having a first surface and a second surface parallel with said plane, said offset handle having a distal end fastened directly to the second side edge and positioned at a predetermined distance from said guard member to establish a channel having a width "w" between a first channel edge formed by the guard member and a second channel edge formed by the handle, with said channel centered about and extending in the direction of the axis and with the first and second surfaces of said offset handle extending away from the rear edge and past the cutting edge of the blade to a grip at a proximal end forming the proximal edge of the cutter, wherein the grip is directly disconnected from the guard and is inclined away from the channel, wherein the cutting edge and the rear edge of the blade are presented across the width of the channel, and wherein the cutting edge of the blade is inclined at an angle $\alpha$ relative to the axis and to the channel edges to facilitate cutting;

holding the grip of the offset handle of the safety cutter; and drawing the safety cutter over the lamina to advance the lamina through the channel and against the cutting edge and one channel edge to facilitate cutting.

6. A method as recited in claim 5 wherein the width "w" across the channel between the offset handle and the guard member is greater than approximately 0.125 inches.

7. A method as recited in claim 5 wherein the blade has a top surface and a bottom surface, and wherein the top surface and the bottom surface of the blade are exposed in the channel from the cutting edge to the rear edge.

8. A method as recited in claim 5 wherein the guard member is circumscribed by a guard edge, wherein the handle is circumscribed by a handle edge, wherein the guard edge and handle edge are separated by a channel distance, and wherein the channel distance is always greater than or equal to the width "w".

9. A method for cutting a lamina with a hand-held safety cutter which comprises the steps of:

providing a hand-held safety cutter having a proximal edge and a distal edge defining a plane, with the safety cutter having: (a) a planar blade co-planar with the plane formed by the cutter and defining an axis, said blade having a first side edge and a second side edge parallel to the axis, and a cutting edge and a rear edge extending between the first side edge and the second side edge, wherein the rear edge of said blade forms the distal edge of the cutter, (b) a substantially planar guard member fastened directly to the first side edge of the blade with the axis being non-coincident with the guard member, with said guard member having a first surface and a second surface parallel to said plane, and (c) a substantially planar handle offset from and non-coincident with the axis, said offset handle having a first surface and a second surface parallel to said plane, with said offset handle having a distal end fastened directly to the second side edge of the blade, with the offset handle positioned at a predetermined distance from said guard member to establish a channel having a width "w" between a first channel edge formed by the guard member and a second channel edge formed by the offset handle, wherein the channel extends between the cutting edge and the rear edge of said blade, with said channel being centered about the axis, wherein the first and second surfaces of said offset handle are parallel with said plane and extend away from the rear edge past the cutting edge to a grip positioned at a proximal end forming the proximal edge of the cutter, wherein the grip is directly disconnected from the guard and is inclined away from the channel, and wherein the cutting edge of the blade is inclined at an angle $\alpha$ relative to the axis and to the channel edges;

gripping said grip of said offset handle; and drawing the safety cutter over the lamina to advance the lamina through the channel and against the cutting edge and one channel edge to facilitate cutting.

10. A method as recited in claim 9 wherein the width "w" is greater than approximately 0.125 inches.

11. A method as recited in claim 10 wherein each lamina has a thickness "t" less than the width "w".

12. A method as recited in claim 9 wherein the blade has a top surface and a bottom surface, and wherein the top surface and the bottom surface of the blade are exposed in the channel from the cutting edge to the rear edge.

13. A method as recited in claim 9 wherein the guard member is circumscribed by a guard edge, wherein the handle is circumscribed by a handle edge, wherein the guard edge and handle edge are separated by a channel distance, and wherein the channel distance is always greater than or equal to the width "w".

* * * * *